US006941606B2

(12) United States Patent
Mariani et al.

(10) Patent No.: US 6,941,606 B2
(45) Date of Patent: Sep. 13, 2005

(54) SHEET AND WEB CLEANER ON SUCTION HOOD

(75) Inventors: Peter Mariani, Harleysville, PA (US); Robert Myers, Harleysville, PA (US)

(73) Assignee: ElectroStatics, Incorporated, Harleysville, PA (US)

( * ) Notice: Subject to any disclaimer, the term of this patent is extended or adjusted under 35 U.S.C. 154(b) by 379 days.

(21) Appl. No.: 10/186,696

(22) Filed: Jul. 2, 2002

(65) Prior Publication Data

US 2004/0003475 A1 Jan. 8, 2004

(51) Int. Cl.[7] ..... B08B 5/04; B08B 6/00

(52) U.S. Cl. ..... 15/1.51; 15/309.1; 361/213

(58) Field of Search ..... 15/1.51, 306.1, 15/308, 309, 309.1, 309.2, 345; 361/213, 214, 222

(56) References Cited

U.S. PATENT DOCUMENTS 2,015,583 A * 9/1935 Bartsch ..... 15/308
3,264,173 A * 8/1966 Frick ..... 162/274
3,395,042 A * 7/1968 Herbert, Jr. ..... 134/1
3,668,008 A * 6/1972 Severynse ..... 134/1
4,281,431 A * 8/1981 Nierlich et al. ..... 15/1.51
4,454,621 A * 6/1984 Testone ..... 15/1.51
4,727,614 A * 3/1988 Swistun ..... 15/1.51
5,596,783 A 1/1997 Testone
5,836,044 A * 11/1998 Sinnett et al. ..... 15/309.1
5,958,190 A * 9/1999 Gregersen et al. ..... 162/275
5,980,646 A * 11/1999 DeRosa ..... 134/21
6,598,261 B2 * 7/2003 Howard ..... 15/308

* cited by examiner

*Primary Examiner*—Terrence R. Till
(74) *Attorney, Agent, or Firm*—Nath & Associates PLLC; Gary M. Nath; Gregory B. Kang

(57) ABSTRACT

A sheet and web cleaner has a pair of substantially identical units in facing relation, providing a path for transporting a sheet or web therebetween. Each unit includes a suction hood with an inlet slot. A pair of channels adjacent and parallel thereto have a pressurized air ionizing bar which discharges ionized air at high velocity onto a moving sheet or web. A faceplate covers the channels and the inlet slot and has a tapered central elongate inlet opening which overlies the inlet slot. Elongate air discharge openings overly each of the channels adjacent the inlet opening. A plurality of spaced ridges are disposed on a side of the faceplate proximate the sheet or web oriented relative to a direction of travel of the sheet or web from a travel direction towards respective edges of the sheet or web. Spaces between the ridges communicate with the inlet and discharge openings.

13 Claims, 12 Drawing Sheets

SHEET AND WEB CLEANER ON SUCTION HOOD

FIELD OF THE INVENTION

The present invention relates to an apparatus for cleaning particles from moving sheets and webs; and more particularly to a faceplate and ionization air point for such an apparatus.

BACKGROUND OF THE INVENTION

In many industries, sheets and webs of indeterminate length are fed to various processing apparatus, such as printing, gluing, winding, etc. It is important in many instances that these sheets and webs be cleaned of dust and particles.

A known sheet and web cleaning apparatus is disclosed in U.S. Pat. No. 5,596,783 to Testone, a copy of which is incorporated herein by reference in its entirety. In the Testone '783 patent a sheet or web cleaner comprises a pair of substantially identical facing units, each having a longitudinal suction hood having a generally rectangular inlet slot therein. On either side of and parallel to the inlet slot is a channel containing a pressurized ionizing bar which comprises a hollow tube, a plurality of ionizing points extend from the tube, and small holes adjacent each ionizing point discharge air at high velocity. The sheet or web passes through a pair of opposed units transversely of the longitudinally extending suction hoods, and between respective faceplates on the units.

Each faceplate is of a smooth, hard material, such as aluminum, steel or a hard plastic material, and has in a face side facing toward the sheet or web a series of spaced, parallel ridges which extend part way through a thickness of the faceplate. The ridges are aligned parallel to each other and are inclined relative to the direction of movement of a sheet or web through the apparatus, and are also inclined to the axis of the suction hood, and to the axes of the ionizing bars. The parallel aligned ridges each have a leading end and a trailing end relative to the direction of travel of the sheet or web, and are aligned obliquely with respect to the direction of travel. In one longitudinal portion of each faceplate the leading ends of the ridges are substantially oriented so as to point away from a co-planar transverse center line through the faceplate in the direction of travel of the web, while the trailing ends are substantially oriented so as to point towards the transverse center line. In another longitudinal portion of each faceplate the leading ends of the ridges are substantially oriented so as to point toward the transverse center line while the trailing ends are substantially oriented so as to point away from the transverse center line.

The ridges of the faceplate are of generally triangular cross-section, each having an apex facing towards and relatively close to the sheet or web, and facing away from the suction hood. Spaces between the ridges provide a plurality of converging air paths which are in communication with elongate openings in an oppositely facing face side surface of the faceplate, and which extend partly through the faceplate thickness.

In the oppositely facing face side surface of the faceplate there is a central, elongate inlet opening of tapering width, with the greater width remote from a suction end of the suction hood in order to permit substantially equal volumes of air to flow into the suction hood through its rectangular inlet slot irrespective of a relative position along a longitudinally extending length of the suction hood. There is also an elongate side discharge opening in the faceplate on either side of the central tapered inlet opening, each of which is in registry with a corresponding ionizing bar to permit ionized air discharged from the ionizing bars to flow through the respective discharge openings in the faceplate and through the spaces between the ridges.

High velocity ionized air currents created by the flow of ionized air from the ionizing bars flows through the respective discharge openings in the faceplate and through the spaces between the ridges. The high velocity ionized air strikes the moving sheet or web neutralizing the static electricity on both the sheet or web material being processed and the contaminant particles dislodging the particulate making the particulate airborne, while an airflow induced by suction draws the air and airborne particles into the suction hood.

The above described prior art apparatus has been found to have a deficiency when cleaning relatively lightweight, sensitive web materials such as tissue papers, thin gauge films and/or metal foils. In applications involving thin, lightweight sheets or webs the lightweight sheets or webs have been found to be susceptible to a lateral displacement by the induced air current relative to the direction of travel of the web. When the high velocity air strikes the lightweight sheet or web, the sheet or web material on the one longitudinal side of the apparatus whose leading ends of the ridges are oriented so as to point away from the transverse centerline have been found to track along and follow the path of the ridges from their respective leading ends toward the trailing ends as the sheet or web travels along the direction of travel. The result has been that a lateral side portion of the sheet or web on the one longitudinal side tended to be displaced towards the transverse centerline as the web traveled through the apparatus with the result that the sheet or web material became bunched up and wrinkled along the one longitudinal side. Consequently, the one longitudinal side could not be adequately cleaned, and downstream processes were adversely impacted because the sheet or web was not smooth and wrinkle free. This required that the entire sheet or web feeding and handling apparatus be stopped, and that the web material be straightened and smoothed out. This was time consuming, required labor to remedy the situation, and caused interruption of production.

It has been further observed that lightweight sheets and webs tend to travel through the cleaning apparatus tangential to the face side of one or the other of the faceplates of the opposed units; and that due to transient variations in, for example, the suction or an amount of tension under which the sheet or web is drawn through the apparatus, the faceplate against which the sheet or web travels tangentially can change, the sheet or web sometimes exhibiting oscillatory behavior wherein the sheet or web flutters between the opposed faceplates.

Due to the inconsistent and sometimes oscillatory behavior of the sheet or web relative to the faceplate against which the sheet or web aligns itself tangentially, attempts to mitigate the lateral displacement of the sheet or web by using two similarly structured, oppositely aligned faceplates, a first faceplate with a general left-to-right alignment of the ridges, and a second faceplate, identical to the first, but installed in an inverted or opposed orientation relative to the first faceplate and thus having a general right-to-left alignment of the ridges have been unsuccessful.

SUMMARY OF THE INVENTION

In a first preferred embodiment of the present invention there is provided a faceplate for a cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, portions of spaces between said first parallel ridges and portions of spaces between said second parallel ridges being said through openings; wherein said first and second parallel ridges are disposed bilaterally symmetrically about a transverse central axis of said plate.

In a second preferred embodiment of the present invention there is provided a faceplate for a cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, said first and second parallel ridges being disposed bilaterally symmetrically about a transverse central axis of said plate, each of said first and second parallel ridges having a leading end and a trailing end in a direction of travel of said moving web; wherein leading ends of said first parallel ridges on a first side of said transverse central axis are disposed nearer said transverse central axis than trailing ends thereof; and leading ends of said second parallel ridges on a second side of said transverse central axis are disposed nearer said transverse central axis than trailing ends thereof.

In another preferred embodiment of the present invention there is provided a faceplate for a cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, said first and second parallel ridges being disposed bilaterally symmetrically about a transverse central axis of said plate and obliquely inclined thereto; a plurality of transverse minor axes parallel to, and disposed longitudinally away from, said transverse central axis; and further comprising: a plurality of lateral ridge sets, each lateral ridge set comprising ones of said series of first parallel ridges and ones of said series of second parallel ridges; wherein each said lateral ridge set is disposed bilaterally symmetrically about a corresponding one of said plurality of transverse minor axes.

Associated with each preferred embodiment of the present invention, a pair of opposed bilaterally symmetrical faceplates is provided for a sheet and web cleaner having a pair of substantially identical facing units, each having a longitudinal suction hood having a generally rectangular inlet slot therein. On either side of and parallel to the inlet slot is a channel containing a pressurized ionizing bar which comprises a hollow tube, a plurality of ionizing points extending from the tube, and small holes to discharge air at high velocity. In a conventional embodiment of the ionizing bar the small holes are adjacent each ionizing point; while in a particularly preferred embodiment of the ionizing bars of the present invention the ionizing points are hollow, needle-like structures having the small holes therethrough and terminated at tips thereof. The sheet or web passes through a pair of opposed units as above described, transversely of the longitudinally extending suction hoods, and between respective faceplates on the units.

Each faceplate is of smooth hard material, such as aluminum, steel, or other hard plastic material, and has in the side adjacent the sheet or web a series of spaced, parallel ridges which extend part way through the thickness of the faceplate. The ridges are inclined to the direction of travel of a sheet or web through the apparatus, and are also inclined to the axis of the suction hood, and to the axes of the ionizing bars. The ridges of the faceplate are preferably of generally triangular cross-section, each having an apex relatively close to the sheet and web, and remote from the suction hood, the spaces between the ridges provide a plurality of converging air paths which are in communication with elongate openings in the opposite surface of the faceplate, which also extend partly through the faceplate thickness. There is a central, elongate inlet opening which is of tapering width, with the greater width remote from the suction end of the suction hood in order to permit the flow of equal quantities of air into the suction hood through the rectangular inlet slot of the suction hood. There is also provided an elongate side discharge opening in the faceplate on either side of the central tapered inlet opening, each of which is in registry with an ionizing bar to permit ionized air discharged from the ionizing bar to flow through the discharge openings in the faceplate and through the spaces between the ridges. The high velocity ionized air strikes the moving sheet or web, neutralizing the electrostatic attraction of particles to the sheet or web, the flow induced by suction carrying them into the suction hood.

In the preferred embodiment of the faceplates, on each longitudinal side of each faceplate leading ends of all ridges are oriented so as to point substantially towards a transverse center line defined by the direction of travel of the sheet or web, while all trailing ends of the ridges are oriented so as to point away from the transverse center line. When the high velocity air strikes the lightweight sheet or web, the sheet or web material on each of the longitudinal sides is induced to track along and follow the path of the ridges from their respective leading ends to the trailing ends as the sheet or web travels along the direction of travel with the result that each of the lateral side portions of the sheet or web tends to be drawn away from the transverse centerline as the web travels through the apparatus with the result that web material remains smooth and flat through the apparatus.

In an alternative embodiment of the faceplates, one or more transverse minor axes are defined parallel to the transverse centerline. On longitudinal sides of each transverse minor axis leading ends of a set of ridges are oriented so as to point substantially towards the respective transverse minor axis while trailing ends of the set of ridges are oriented so as to point away from the transverse minor axis. As in the preferred embodiment, when the high velocity air strikes the lightweight sheet or web, the sheet or web material on outermost portions of each of the longitudinal sides is induced to track along and follow the path of the ridges from their respective leading ends to the trailing ends as the sheet or web travels along the direction of travel with the result that each of the lateral side portions of the sheet or web tends to be drawn away from the transverse centerline as the web travels through the apparatus with the result that web material remains smooth and flat through the apparatus.

These and other objects, features, and advantages of the invention will be better understood by those skilled in the art by reference to the following detailed description taken together with the following drawings.

DESCRIPTION OF THE PREFERRED EMBODIMENT

Figure 1:
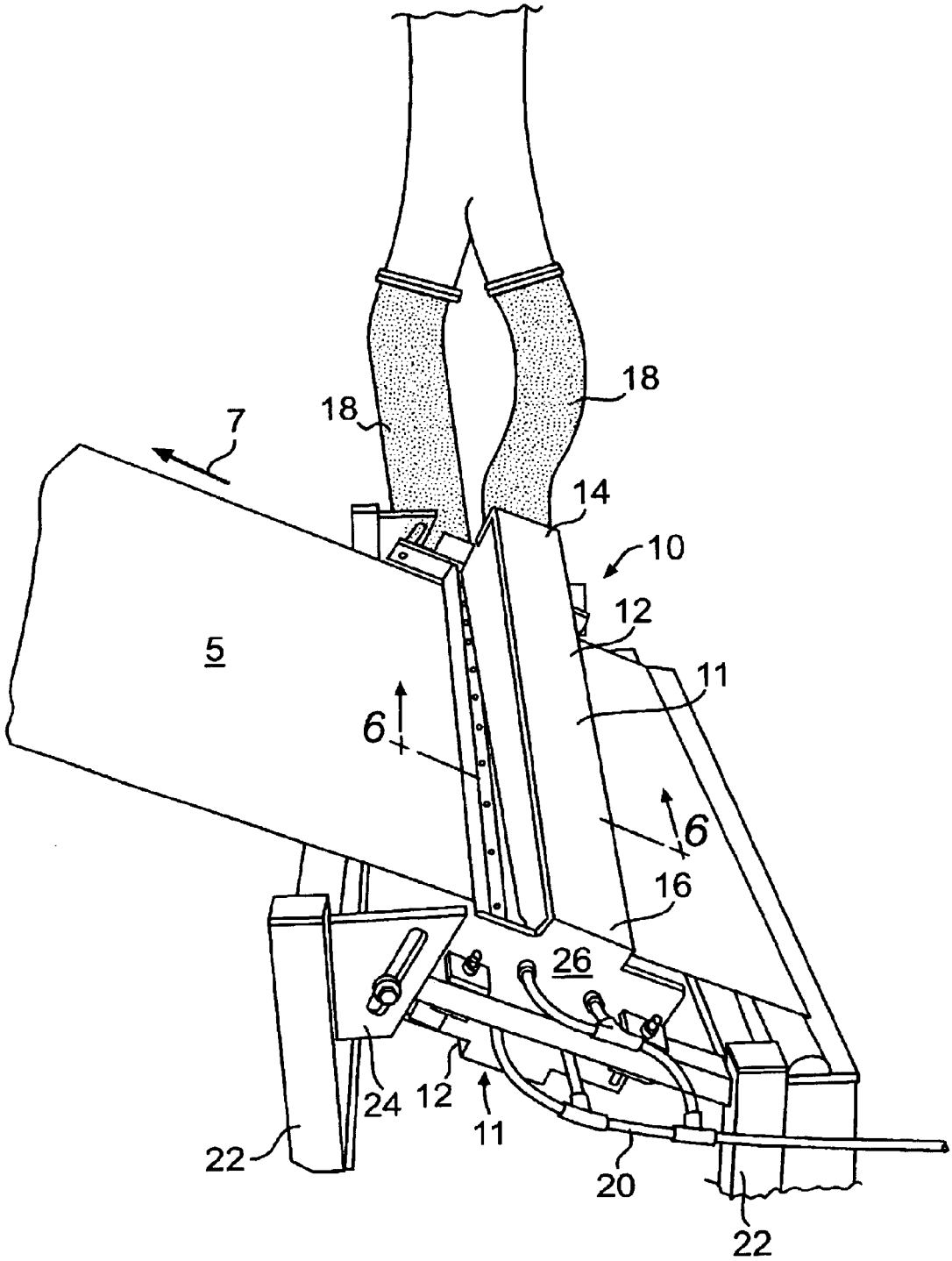
FIG. 1 PRIOR ART
FIG. 1 is a perspective view of a conventional sheet and web cleaner.

Referring now to the drawings in which like numerals identify like components throughout the several views, there is shown in FIG. 1 a sheet 5 travels in a direction of travel 7 through a conventional sheet and web cleaner 10 to be cleaned. Sheet 5 can be a relatively fragile, easily scratched material such as a coated paper or a plastic film such as acetate and Mylar; can be a relatively heavy weight sheet or web material, or can be a relatively thin material such as tissue paper or a thin metal foil. Typically, sheet 5 can have a travel speed through sheet and web cleaner 10 of approximately 3,000 feet per minute.

Sheet and web cleaner 10 comprises a pair of substantially identical units 11, one located on one side or above sheet 5, and the other located on another side or below sheet 5. Each unit includes an elongate suction hood 12 having a large end 14, and being of decreasing cross-section to an opposite, closed end 16. At end 14, a duct 18 is connected to each of suction hoods 12. Ducts 18 are connected to a vacuum fan or other suction device (not shown). A pressurized air conduit 20 provides pressurized air to ionizing bars as described below.

Sheet and web cleaner 10 is supported on legs 22 and a support frame 24, to which is attached through mounting plate 26.

Figure 2:
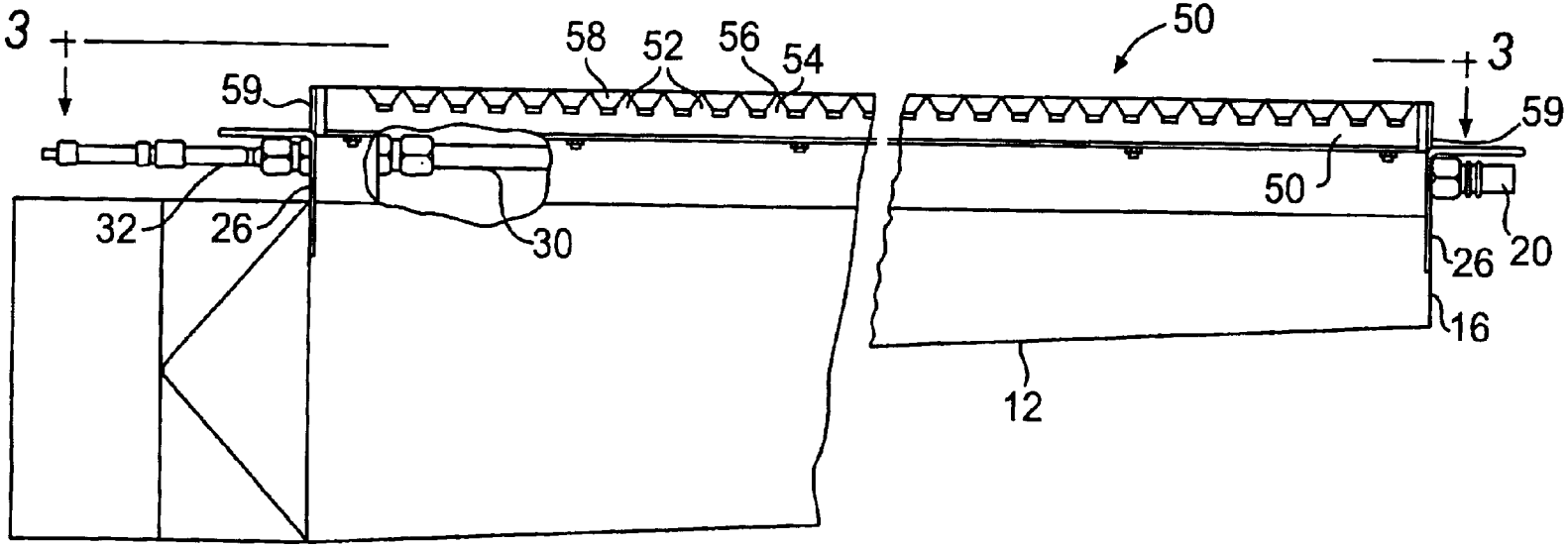
FIG. 2 PRIOR ART
FIG. 2 is an elevational view with parts removed and broken away of a suction hood and faceplate forming a unit of the conventional sheet and web cleaner of FIG. 1.

As shown in FIG. 2, suction hood 12 is of somewhat pyramidal shape, having above it an ionizing bar 30 which is linearly extending from end to end of suction hood 12. At one end, there is connected to ionizing bar 30 an air conduit 20 which supplies air at relatively high pressure. Adjacent the end of ionizing bar 30 which is remote from the air conduit 20 is an electrical conductor 32 for supplying electrical current to ionizing bar 30 from a suitable source (not shown).

In the conventional sheet or web cleaner 10, faceplate 50 extends over the ionizing bars 30, and comprises a series of spaced ridges 52 each of which, as shown, has a portion 54 of generally triangular cross-sectional shape with an apex 56 to provide a series of contact elements to be engaged by sheet 5 passing through sheet and web cleaner 10. Other geometric cross-sectional shapes for portions 54 can be used that provide for a line of tangential contact between sheet 5 and ridges 52 such as semi-circular, semi-elliptical, parabolic and hyperbolic cross sections. Ridges 52 extend part way through the thickness of faceplate 50, and between ridges 52 are spaces 58. Faceplate 50 is machined from a plate which has opposite sides and is of relatively smooth, hard plastic material, such as aluminum, steel, or other hard plastic material.

Figure 3:
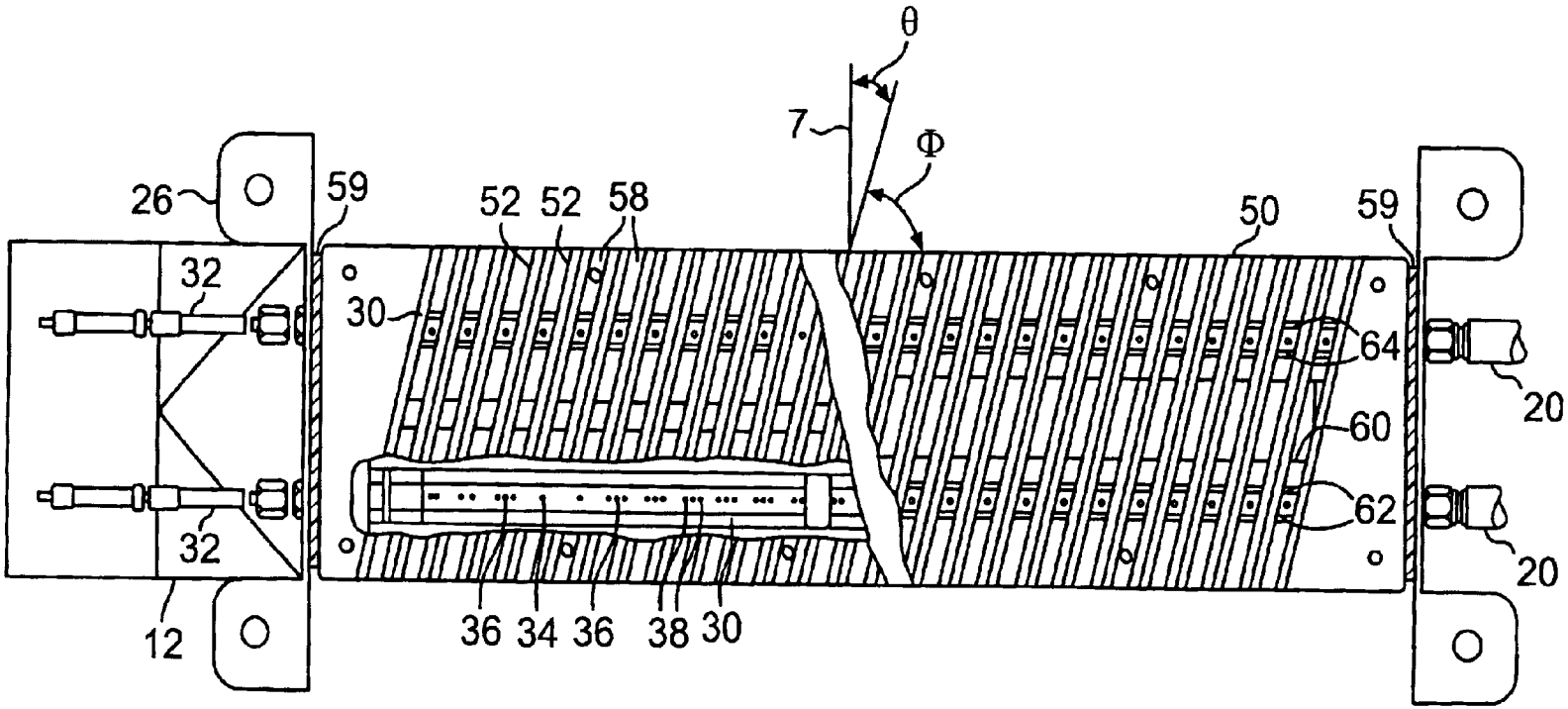
FIG. 3 PRIOR ART
FIG. 3 is a view taken on line 3—3 of FIG. 2, with parts removed and broken away.

As shown in FIG. 3 a pair of substantially identical spaced ionizing bars 30 in parallel relation each has air conduit 20 connected at one end and conductor 32 connected at the other end. Each ionizing bar 30 comprises a hollow, preferably cylindrical, tube 34 having a series of transverse linearly spaced ionizing points 36 extending therefrom (see FIG. 6). On either side of each of ionizing points 36 is an opening 38 for the discharge of pressurized air in a direction substantially parallel to ionizing points 36. There is thereby discharged from each of ionizing bars 30 a high velocity, low volume stream of air, which contains ions as created by the application of electrical current from conductor 32 to ionizing points 36.

Spaced parallel ridges 52 of faceplate 50 are inclined at an oblique angle $\phi$ to the axis of the ionizing bars 30 and at an angle $\theta$ to direction of travel 7 of sheet 5. At the ends of faceplate 50, there are provided sealing strips 59, to close any gap between faceplate 50 and mounting plate 26. On the opposite side of faceplate 50 there are elongate openings including a tapered central elongate opening 60 and a pair of side elongate openings 62 and 64, the openings 62 and 64 being in registry with ionizing bars 30. Openings 60, 62 and 64 extend part way through the thickness of faceplate 50.

Figure 4:
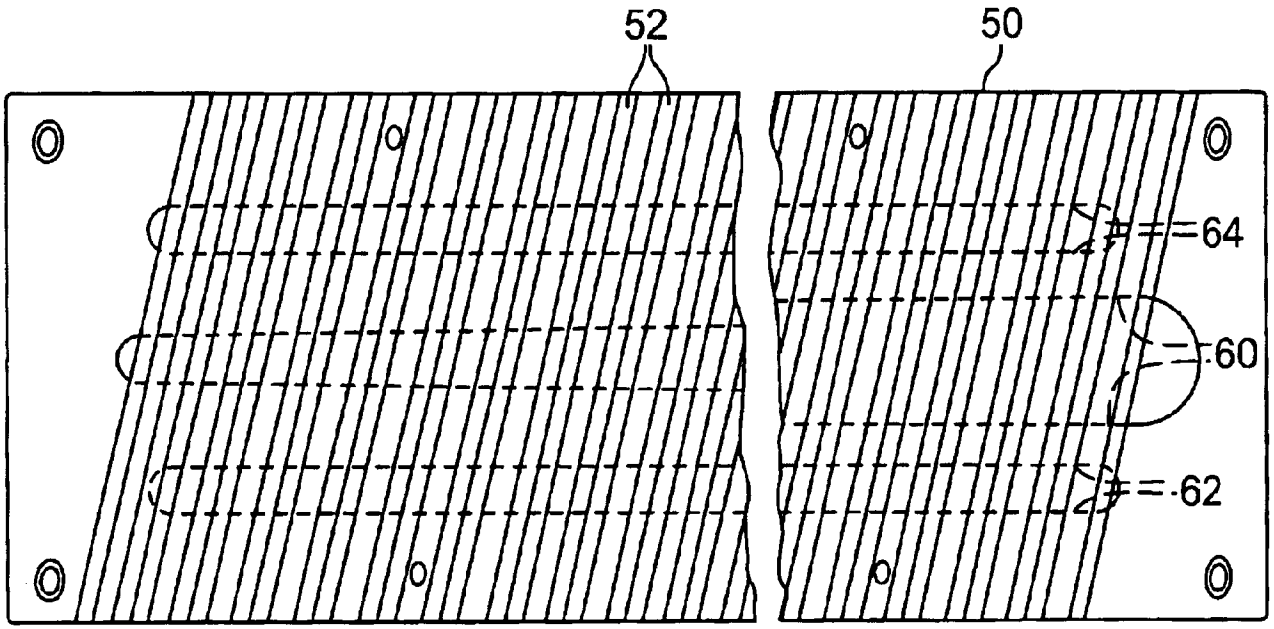
FIG. 4 PRIOR ART
FIG. 4 is a plan view of one face side of a conventional faceplate, with parts broken away.
Figure 5:
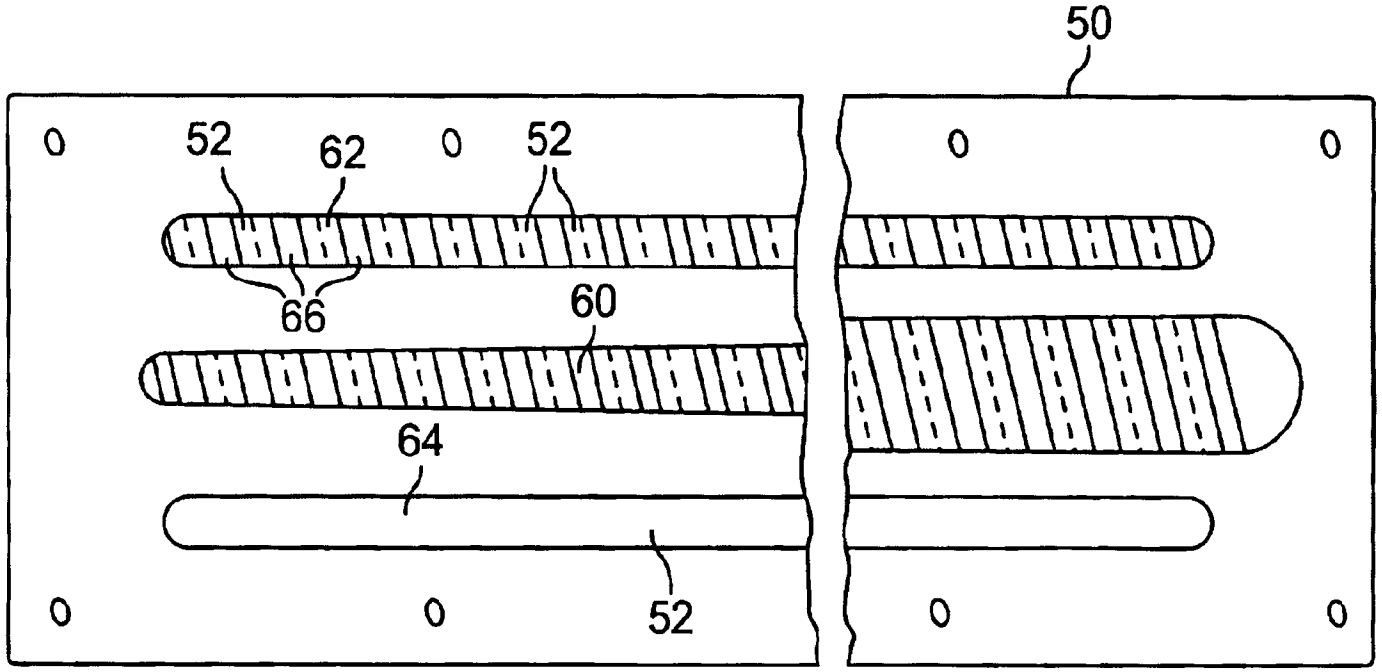
FIG. 5 PRIOR ART
FIG. 5 is a plan view of an opposite face side of the faceplate of FIG. 4.

As shown in FIGS. 4–5, central tapered elongate inlet opening 60 is wider at one end and tapers to a narrow width at another end thereof. Spaces 58 between ridges 52 provide openings which are in communication with openings 60, 62 and 64 to permit air to flow from the ionizing bars 30 through the faceplate 50 to strike sheet 5. Central tapered elongate opening 60 permits air to flow through the spaces 58 of faceplate 50 and into the suction hood 12. The area of the central tapered elongate inlet opening 60 is substantially equal to the combined areas of the elongate side openings 62 and 64. Channels 66 between adjacent ones of ridges 52 permit discharged air to travel parallel to ridges 52 from areas adjacent respective discharge openings 62, 64 to an area adjacent opening 60.

Referring now to FIG. 5, there is shown the opposite face side of faceplate 50 to that shown in FIG. 4, where there may be seen elongate side openings 62 and 64, and between them central tapered elongate opening 60. Extending in inclined configuration across the openings 60, 62 and 64 are ridges 52 with spaces 58 between them.

Figure 6:
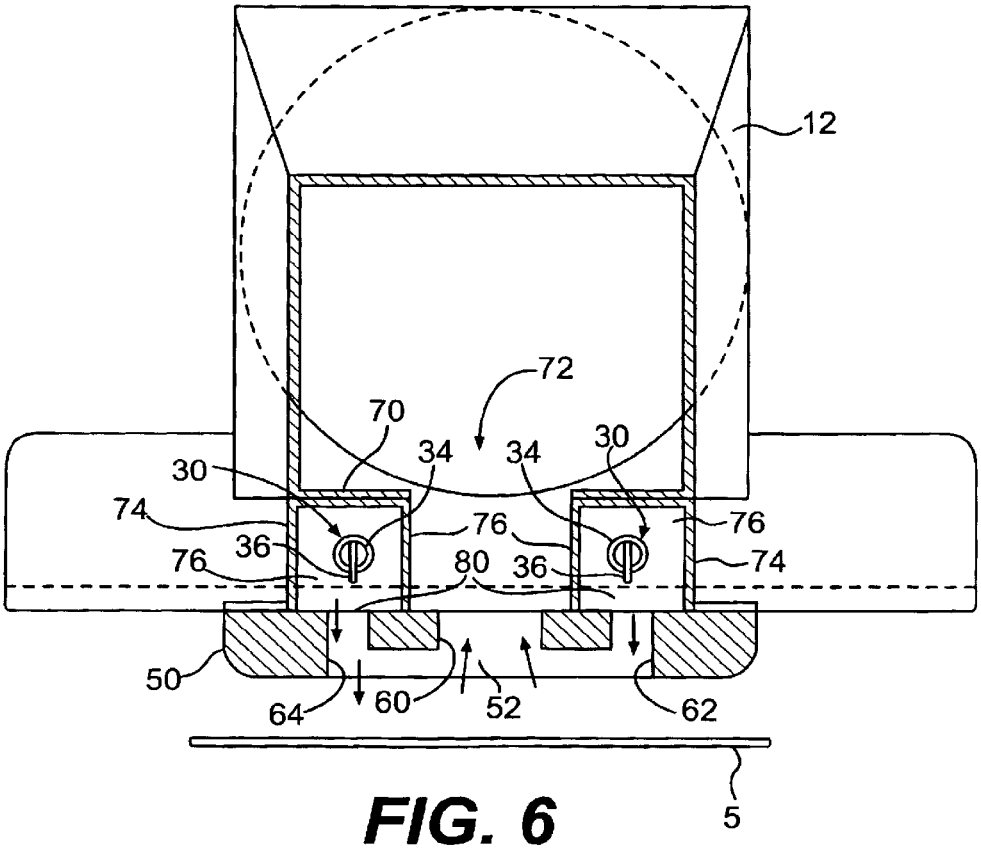
FIG. 6 PRIOR ART
FIG. 6 is a cross-sectional view taken on the line 6—6 of FIG. 1.

Referring now to FIG. 6, there is shown suction hood 12 in cross-section. Suction hood 12 is of generally square cross-sectional shape, and of modified pyramidal configuration in the longitudinal direction. A wall 70 of suction hood 12 has a rectangular longitudinally extending inlet slot 72, and on either side of the inlet slot 72 there is mounted a pair of spaced parallel channels 74, each of the channels 74 comprising a pair of parallel walls 76 and 78. The walls 76 and 78 of each channel 74 provide an elongate rectangular air discharge opening 80 between them, and between the proximal walls 78 of the channels 74 there is a continuation of the inlet slot 72.

Faceplate 50 underlies and is in engagement with channels 74, with elongate side openings 62 and 64 in registry with openings 80 in each of the channels 74; and tapered elongate central opening 60 in registry with an elongate rectangular opening between walls 78 of channels 74 and inlet slot 72 of suction hood 12.

In operation, sheet or web 5 is caused to pass through sheet and web cleaner 10, and more specifically, between, parallel to and transversely of two spaced, parallel faceplates 50 and transversely of said elongate side openings 62 and 64. Sheet 5 moves at high speed, which may be approximately 3,000 feet per minute. As sheet 5 moves through sheet and web cleaner 10, ionizing bars 30 generate ions, which are carried therefrom by high velocity air exiting from the openings of holes 38 in tube 34. The high velocity air carries the ions generated by the ionizing points 36 through the opening 80 in each of the channels 74 and thence through respective openings 62, 64 in faceplate 50 and into the spaces 58 between ridges 52. The ionized air strikes a face of moving sheet 5, and is drawn through channels 66 between ridges 52 into central tapered elongated central opening 60, the opening between the walls 78 of the channels 74, the inlet slot 72, and into suction hood 12 from which it is remotely filtered and/or exhausted (not shown).

Figure 7A:
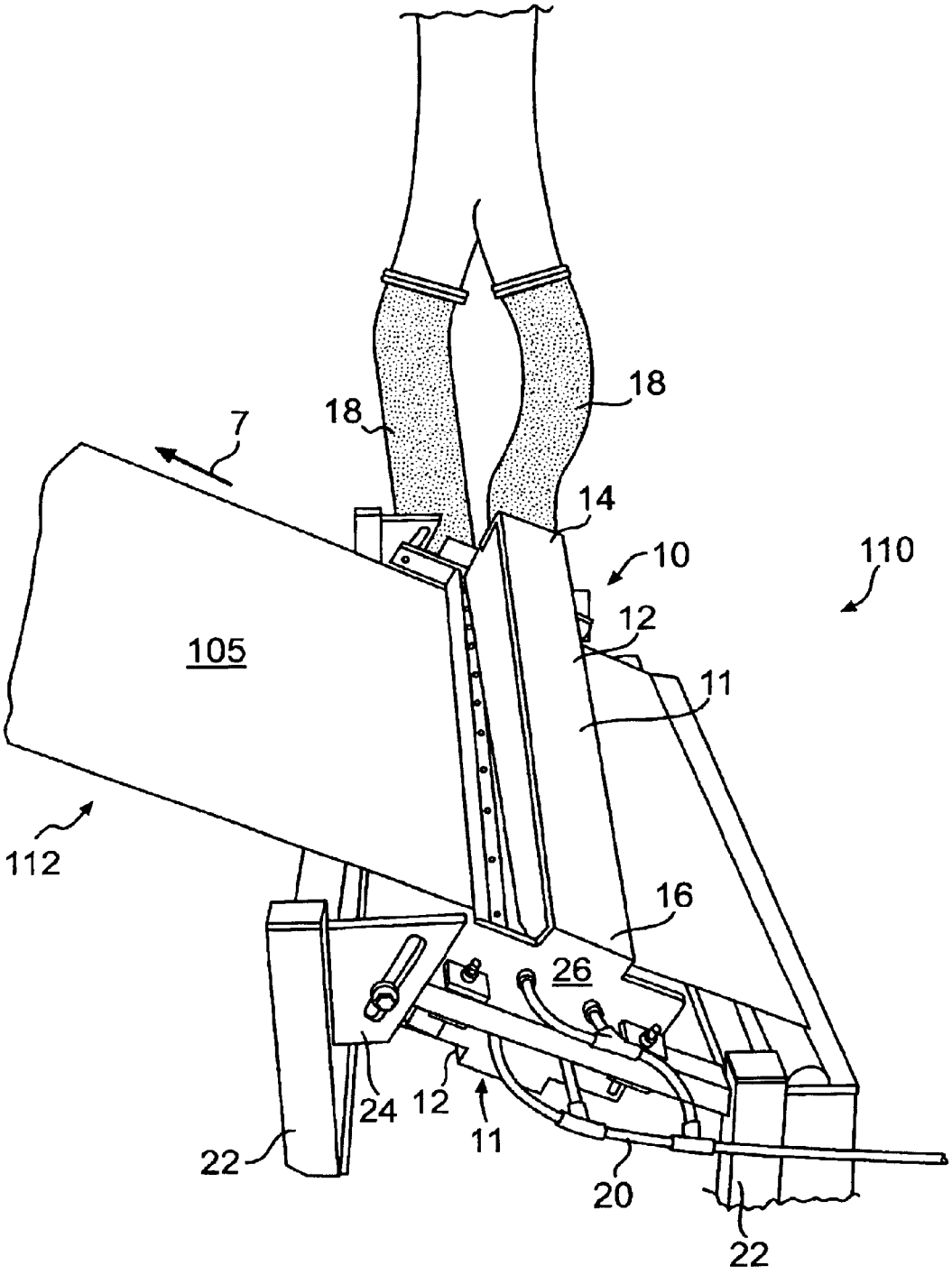
FIG. 7A PRIOR ART
FIGS. 7A–7B show a plan view of a sheet or web moving through the prior art cleaning machine of FIG. 1 equipped with the faceplate of FIG. 4.
Figure 7B:
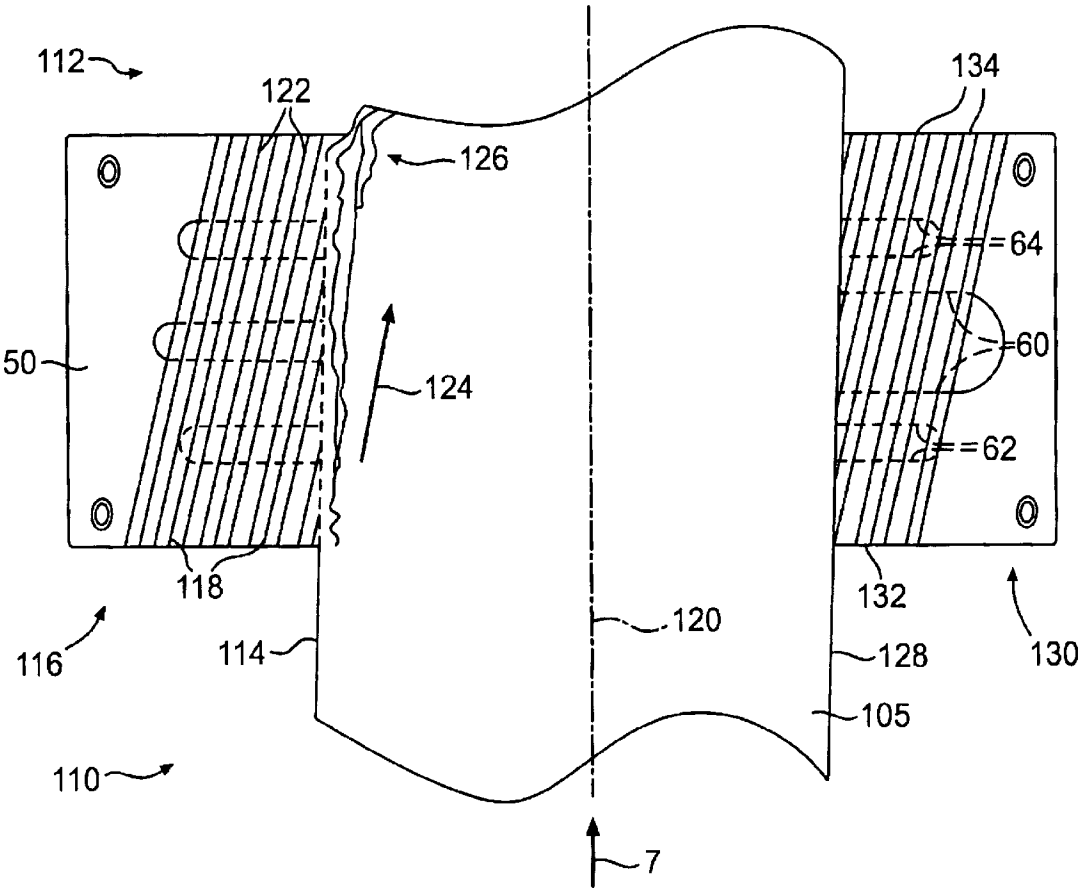
FIG. 7B PRIOR ART

As shown in FIGS. 7A–7B, a lightweight sheet or web 105 is moved through sheet or web cleaner 10 across faceplates 50 in direction of travel 7 transverse to faceplates 50. Lightweight sheet or web 105 is of relatively low mass and has negligible structural rigidity in both its direction of travel 7 and transverse to its direction of travel. Sheet or web 105 is drawn through sheet or web cleaner 10 with a controlled tension on both an upstream side 110 and a downstream side 112 of sheet or web cleaner 10. As sheet or web 105 moves through sheet and web cleaner 10 in direction of travel 7, high velocity air exits from the openings of holes 38 in tubes 34 and passes through openings 62, 64 in each of faceplates 50 and into spaces 58 between ridges 52. Although lightweight sheet or web 105 has negligible structural rigidity in its direction of travel 7, since sheet or web 105 is drawn through sheet or web cleaner 10 with controlled tension on both the upstream and downstream sides 110, 112, sheet or web 10 remains relatively unaffected in direction of travel 7 by airstreams induced by the flow of high velocity air from the openings of holes 38 through openings 62, 64 in each of faceplates 50 and into spaces 58 between ridges 52. However, since lightweight sheet or web 105 has negligible structural rigidity along the longitudinal direction of sheet or web cleaner 10, transverse to direction of travel 7, and since no controlled tension is maintained transverse to the direction of travel 7, a lateral edge 114 of sheet or web 105 on a side 116 of faceplate 50 where ridges 52 have respective leading ends 118 oriented further from a transverse center line 120 of faceplate 50 than corresponding trailing ends 122 thereof, has been observed to be susceptible to distortion in direction 124 along a direction of ridges 52 by airstreams induced by the flow of high velocity air from the openings of holes 38 through openings 62, 64 and by frictional tracking forces induced by ones of apices 56 in contact with an adjacent surface of sheet or web 105 with the result that sheet or web 105 becomes unacceptably bunched-up and/or wrinkled 126 along edge 114 thereby necessitating that production be shut down so that sheet or web 105 can be smoothed out. In contrast, an opposite lateral edge 128 of sheet or web 105 on a side 130 of faceplate 50 where ridges 52 have respective leading ends 132 oriented closer to transverse central axis 120 of faceplate 50 than corresponding trailing ends 134 thereof, no such distortion by airstreams induced by the flow of high velocity air or by frictional tracking forces has been observed as the combined affect of the airflow and frictional tracking forces on side 130 tends to draw lateral edge 128 away from transverse central axis 120 thereby keeping sheet or web 105 smooth.

Figure 8A:
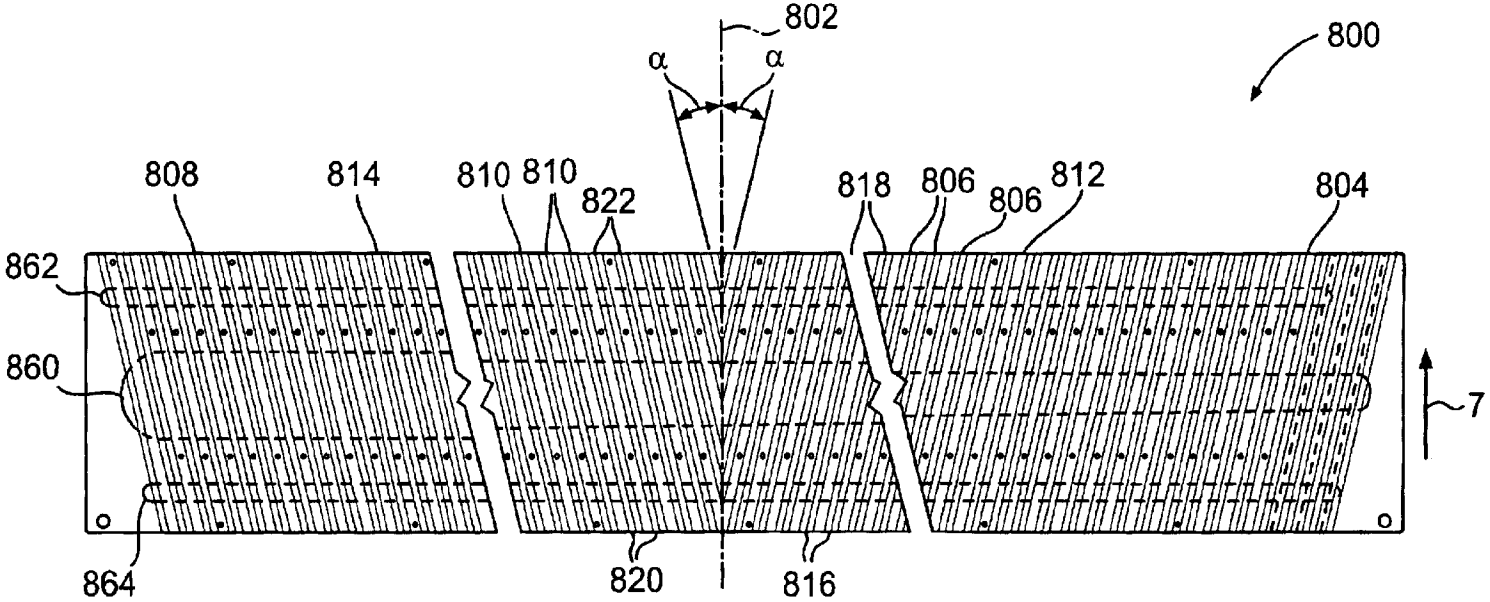
FIGS. 8A–8B are plan and elevational views, respectively, of a first preferred embodiment of a faceplate of the present invention.
Figure 8B:
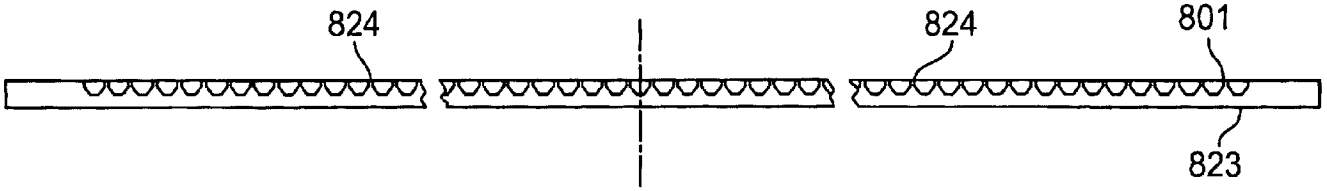

With reference now to FIGS. 8A–8B there is shown a first preferred embodiment of a faceplate 800 of the instant invention. Faceplate 800 is hard and smooth and is preferably made of aluminum, steel or other metal, or a hard plastic material.

A first side face 801 of faceplate 800 has a centrally disposed transverse axis 802. On a first side 804 of transverse central axis 802 is a series of first parallel ridges 806. On a second side 808 of transverse central axis 802 is a series of second parallel ridges 810. First parallel ridges 806 have openings 812 therebetween similar to openings 58 between ridges 52 in faceplate 50. Second parallel ridges 810 similarly have openings 814 therebetween. First and second parallel ridges 806, 810 are oriented oblique to transverse central axis 802 by an angle a and are arranged bilaterally symmetrical thereabout. When viewed in direction of travel 7 of a web 105, leading ends 816 of first parallel ridges 806 on first side 804 of transverse central axis 802 are oriented nearer transverse central axis 802 than corresponding trailing ends 818 thereof, and leading ends 820 of second parallel ridges 810 on second side 808 of transverse central axis 802 are oriented nearer transverse central axis 802 than corresponding trailing ends 822 thereof.

A second face side 823 of faceplate 800 has a tapered central elongate opening 860 and a pair of side elongate openings 862 and 864, similar to elongate openings 60, 62 and 64 of faceplate 50.

First and second parallel ridges 806, 810 are preferably of generally triangular cross-section having apices 824 remote from second face side 823. Alternatively ridges 806, 810 can be of other geometric cross-sectional configurations such as, but not limited to: semi-circular, semi-elliptical, parabolic, or hyperbolic.

An area of tapered central elongate opening 860 is substantially the same as the combined areas of elongate side openings 862, 864.

Unlike the prior art faceplate of FIGS. 1–7, on both side 804 and 808 of faceplate 800 respective first ridges 806 and second ridges 810 are each oriented so that leading ends 816, 820 thereof are all oriented closer to the transverse central axis 802 of faceplate 800 than corresponding trailing ends 818, 822 thereof. Consequently, the combined affect of airstreams induced by the flow of high velocity air from the openings of holes, such as holes 38 (shown in FIG. 3) or holes 1138 (discussed below with respect to FIGS. 10A–10B), through openings 862, 864 and frictional tracking forces induced when apices 824 contact an adjacent surface of sheet or web 105 tends to draw each of lateral edges 114 and 128 away from transverse central axis 820 thereby keeping sheet or web 105 uniformly smooth across its entire width.

Figure 9A:
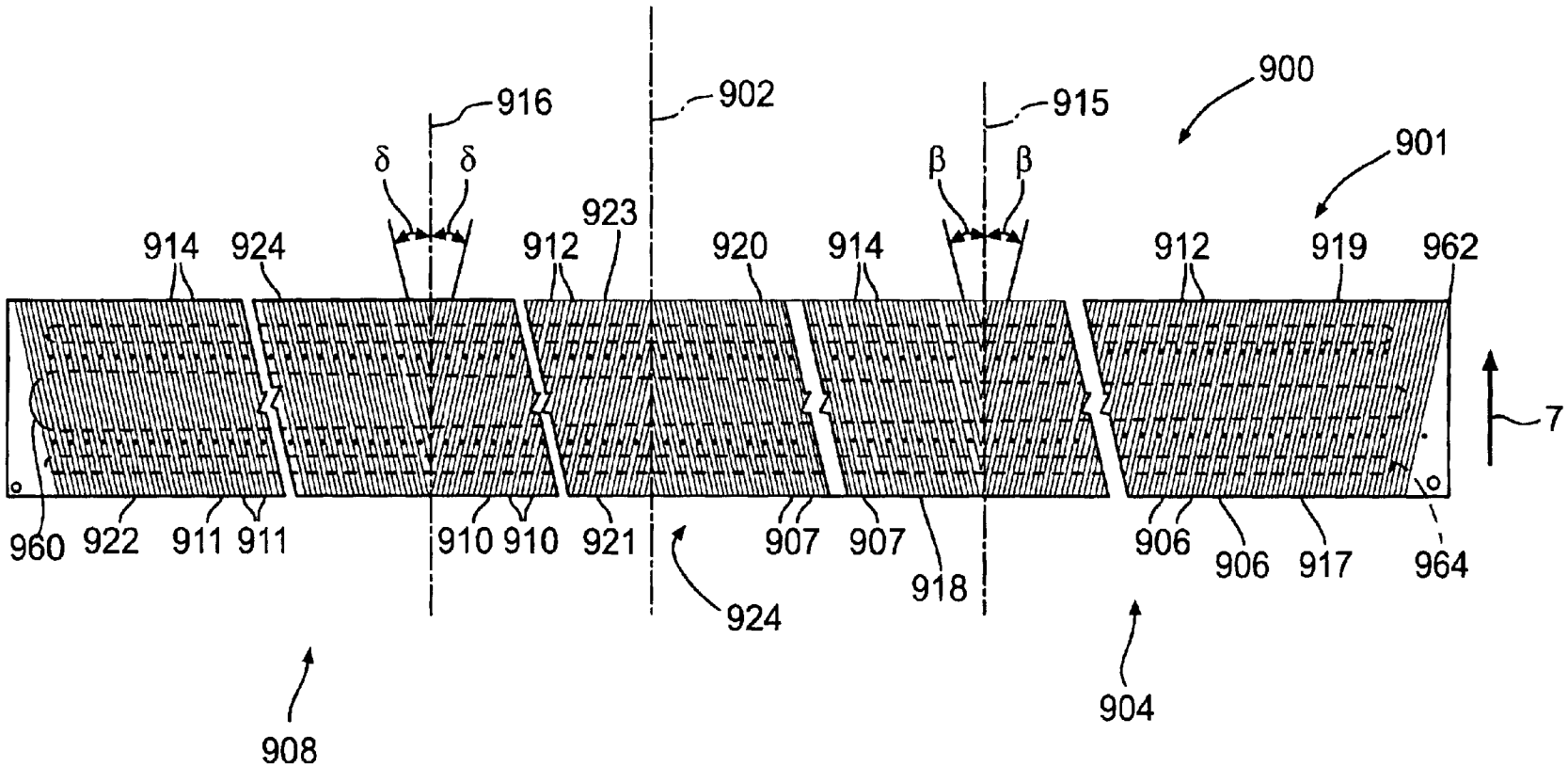
FIGS. 9A–9B are plan views of alternative embodiments of the faceplate of the present invention.

With reference now to FIG. 9A, there is shown an alternative embodiment of faceplate 900 of the present invention having two sets of ridges, each set comprising a corresponding series of first parallel ridges and a series of second parallel ridges wherein each set is disposed bilaterally symmetrical about a respective transverse minor axis, and the faceplate is bilaterally symmetrical about a transverse central axis. Faceplate 900 is similarly of a hard and smooth material such as aluminum, steel or other metal, or a hard plastic material.

A first side face 901 of faceplate 900 has a centrally disposed transverse central axis 902. On a first side 904 of transverse central axis 902 is a first series of first parallel ridges 906 and a first series of second parallel ridges 907. On a second side 908 of transverse central axis 902 is a second series of first parallel ridges 910 and a second series of second parallel ridges 911. First and second series of first parallel ridges 906 and 910 have openings 912 therebetween similar to openings 58 between ridges 52 in faceplate 50. First and second series of second parallel ridges 907, 911 similarly have openings 914 therebetween. On first side 904 of transverse central axis 902 is a first transverse minor axis 915. First series of first parallel ridges 906 and second parallel ridges 907 are oriented oblique to transverse minor axis 915 at an angle β and are arranged bilaterally symmetrical thereabout. On second side 908 of transverse central axis 902 is a second transverse minor axis 916. Second series of first parallel ridges 910 and second parallel ridges 911 are oriented oblique to second transverse minor axis 916 at an angle β and are arranged bilaterally symmetrical thereabout. Preferably first series of first and second parallel ridges 906, 907 and second series of first and second parallel ridges 910, 911 are arranged mutually bilaterally symmetrical about transverse central axis 902. When viewed in direction of travel 7 of a web 105, leading ends 917 of first series of first parallel ridges 906 and leading ends 918 of first series of second parallel ridges 907 are oriented nearer transverse minor axis 915 than corresponding trailing ends 919, 920 thereof. Similarly, leading ends 921 of second series of first parallel ridges 910 and leading ends 922 of second series of second parallel ridges 911 are likewise oriented nearer transverse minor axis 916 than corresponding trailing ends 923, 924 thereof.

A second face side 924 of faceplate 900, opposite face side 901, has a tapered central elongate opening 960 and a pair of side elongate openings 962 and 964, similar to elongate openings 60, 62 and 64 of faceplate 50; and an area of tapered central elongate opening 960 is substantially the same as the combined areas of elongate side openings 962, 964.

As in prior embodiments, the respective series of first and second parallel ridges are preferably of generally triangular cross-section having apices remote from the second face side; and, as before, the ridges can alternatively be of other geometric cross-sectional configurations such as, but not limited to: semi-circular, semi-elliptical, parabolic, or hyperbolic.

Figure 9B:
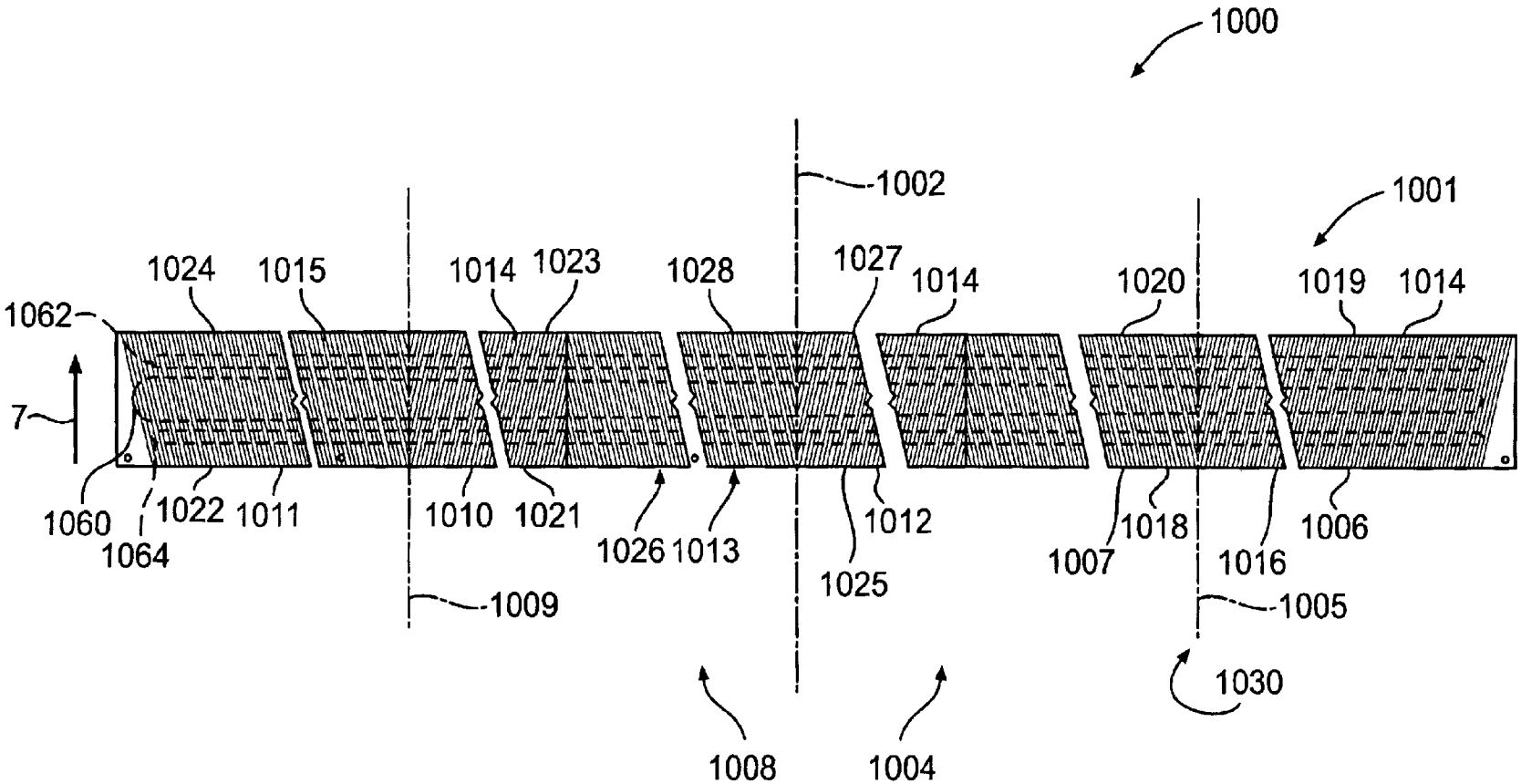

FIG. 9B shown a further alternative embodiment of the present invention having three sets of corresponding series of first and second ridges, a first and a second set each disposed bilaterally symmetrically about a transverse minor axis and a third set centered on the transverse central axis.

Faceplate 1000 has a first side face 1001 with a centrally disposed transverse central axis 1002. On a first side 1004 of transverse central axis 1002 is a first transverse minor axis 1005. A series of first parallel ridges 1006 and a first series of second parallel ridges 1007 are disposed bilaterally symmetrically about first transverse minor axis 1005 and are inclined obliquely thereto. On a second side 1008 of transverse central axis 1002 is a second transverse minor axis 1009. A second series of first parallel ridges 1010 and a second series of second parallel ridges 1011 are disposed bilaterally symmetrically about second transverse minor axis 1009 and are inclined obliquely thereto. A third series of first parallel ridges 1012 and a third series of second parallel ridges 1012 are disposed bilaterally symmetrically about transverse central axis 1002 and are inclined obliquely thereto. Each of first, second and third series of first parallel ridges 1006, 1010, and 1012 has openings 1014 therebetween similar to openings 58 between ridges 52 in faceplate 50. Similarly, each of first, second, and third series of second parallel ridges 1007, 1011, and 1013 similarly have openings 1015 therebetween. Preferably respective series of first and second parallel ridge are collectively arranged mutually bilaterally symmetrical about transverse central axis 1002. When viewed in direction of travel 7 of a web 105, leading ends 1016 of first series of first parallel ridges 1006 and leading ends 1018 of first series of second parallel ridges 1007 are oriented nearer transverse minor axis 1005 than corresponding trailing ends 1019, 1020 thereof. Similarly, leading ends 1021 of second series of first parallel ridges 1010 and leading ends 1022 of second series of second parallel ridges 1011 are likewise oriented nearer transverse minor axis 1009 than corresponding trailing ends 1023, 1024 thereof; and further similarly leading ends 1025 of third series of first parallel ridges 1012 and leading ends 1026 of third series of second parallel ridges 1013 are likewise oriented nearer transverse central axis 1002 than corresponding trailing ends 1027, 1028 thereof.

A second face side 1030 of faceplate 1000, opposite face side 1001, has a tapered central elongate opening 1060 and a pair of side elongate openings 1062 and 1064, similar to elongate openings 60, 62 and 64 of faceplate 50; and an area of tapered central elongate opening 1060 is substantially the same as the combined areas of elongate side openings 1062, 1064.

Further alternative embodiments having other numbers of sets of symmetrically disposed corresponding series of first and second ridges are also possible and would be obvious to persons skilled in the art. Asymmetric configurations are also possible provided that a longitudinally disposed outermost series of first and second parallel ridges on respective outermost longitudinal ends of the faceplate have a sufficient number of parallel ridges oriented with respective leading ends thereof oriented closer to a transverse central axis than corresponding trailing ends thereof so that the combined affect of tracking forces in the longitudinal direction induced by contact between a surface of the sheet or web against apices of the ridges and lateral distortion imparted by the high velocity air impacting on the moving sheet or web tends to draw each lateral edge of sheet or web away from the transverse central axis.

Figure 10B:
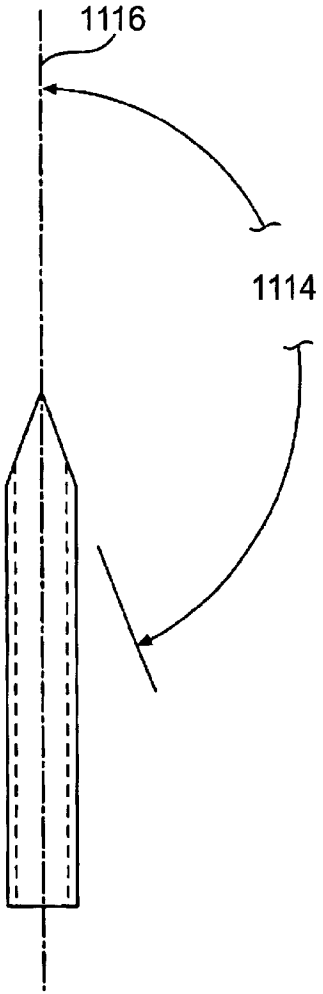
FIGS. 10A–10B are front and side elevational views, respectively, of needle-like ionizing air points of the present invention.
Figure 10A:
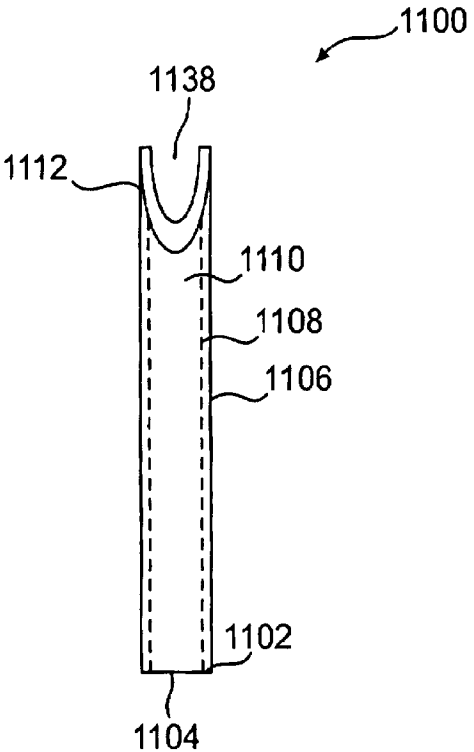

Referring now to FIGS. 10A–10B, a particularly preferred embodiment of ionizing points 1100 is shown. Unlike conventional ionizing points 36 which require holes 38 in ionizing bar 30 adjacent thereto, ionizing points 1100 are hollow, needle-like ionizing points which combine the function of ionizing points 36 with those of holes 38.

Ionizing points 1100 have a base portion 1102 with a proximal opening 1104 therein that connects to an opening (not shown) in ionizing bar 30 in a conventional manner such as welding, brazing, a threaded connection, a friction fit, a twist-lock connection, or other conventional manner. Each ionizing point 1100 comprises a hollow tubular structure 1106 having a tubular wall portion 1108 surrounding a hollow passage 1110. For simplicity of manufacture tubular structure 1106 is preferably of right-circular cross-section; however, other cross-sectional geometries are possible. Tubular structure 1106 extends from its base portion 1102 to a distal end 1112. At distal end 1112 a distal hole 1138 communicates with proximal opening 1104 through hollow passage 1110.

In a particularly preferred embodiment of the present invention, distal end 1112 is beveled on two sides thereof at an obtuse angle 1114 relative to a longitudinal axis 1116 of ionizing point 1100; and is preferably beveled at an angle thereto of approximately 160 degrees. Alternatively, distal end 1112 can be beveled relative to longitudinal axis 1116 around its entire circumference in the nature of a conic section.

High velocity air from ionizing bar is discharged by ionizing points 1100 through holes 1138 in a conventional manner and is ionized thereby.

The present invention has now been described with respect to preferred selected embodiments thereof. However, other embodiments would be obvious to those skilled in the art without departing from the spirit and scope of the appended claims.

We claim:

1. A cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, portions of spaces between said first parallel ridges and portions of spaces between said second parallel ridges being said through openings; wherein said first and second parallel ridges are disposed bilaterally symmetrically about a transverse central axis of said plate.

2. The faceplate as claimed in claim 1, wherein said first and second parallel ridges are obliquely inclined relative to said transverse central axis.

3. The faceplate as claimed in claim 2, wherein each of said first parallel ridges has a leading end and a trailing end in a direction of travel of said moving web, leading ends of said first parallel ridges on a first side of said transverse central axis being disposed nearer said transverse central axis than trailing ends thereof.

4. The faceplate as claimed in claim 2, wherein each of said second parallel ridges has a leading end and a trailing end in a direction of travel of said moving web, leading ends of said second parallel ridges on a second side of said transverse central axis being disposed nearer said transverse central axis than trailing ends thereof.

5. The faceplate as claimed in claim 1, wherein ones of said first and second parallel ridges are of generally triangular, semicircular, semi-elliptical, parabolic, or hyperbolic cross-section, apices thereof remote from said first face side.

6. The faceplate as claimed in claim 1, wherein an area of said central tapered elongate first opening is substantially the same as the combined areas of said elongate longitudinal side openings in said plate.

7. The faceplate as claimed in claim 1, said plate being hard and smooth and having substantially the density of aluminum, steel, or a hard plastic material.

8. The faceplate as claimed in claim 1, further comprising a plurality of transverse minor axes parallel to, and disposed longitudinally away from, said transverse central axis.

9. The faceplate as claimed in claim 8, further comprising: a plurality of lateral ridge sets, each lateral ridge set comprising ones of said series of first parallel ridges and ones of said series of second parallel ridges, each said lateral ridge set being disposed bilaterally symmetrically about a corresponding one of said plurality of transverse minor axes.

10. The faceplate as claimed in claim 9, wherein said first and second parallel ridges of each said lateral ridge set are obliquely inclined relative to said corresponding one of said plurality of transverse minor axes.

11. A cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, said first and second parallel ridges being disposed bilaterally symmetrically about a transverse central axis of said plate, each of said first and second parallel ridges having a leading end and a trailing end in a direction of travel of said moving web; wherein leading ends of said first parallel ridges on a first side of said transverse central axis are disposed nearer said transverse central axis than trailing ends thereof; and leading ends of said second parallel ridges on a second side of said transverse central axis are disposed nearer said transverse central axis than trailing ends thereof.

12. A cleaning apparatus for cleaning from a moving web particles which are adhered to it by static electricity, of the type having a pair of oppositely facing suction hoods each having a pair of ionizing bars providing a source of high velocity ionized air, comprising: a plate having oppositely facing face sides, said plate having in a first face side thereof a central tapered elongate first opening, said first opening being of tapered width a greater width thereof at a first end thereof and a lesser width at a second end thereof; through openings in said plate extended from the opposite face side of said plate to, and in communication with, said central tapered elongate first opening; a pair of elongate longitudinal side openings is said first face side, said side openings in said plate further being in communication with said through openings; a series of spaced, first parallel ridges and second parallel ridges extended on a second face side thereof, said first and second parallel ridges being disposed bilaterally symmetrically about a transverse central axis of said plate and obliquely inclined thereto; a plurality of transverse minor axes parallel to, and disposed longitudinally away from, said transverse central axis; and further comprising: a plurality of lateral ridge sets, each lateral ridge set comprising ones of said series of first parallel ridges and ones of said series of second parallel ridges; wherein each said lateral ridge set is disposed bilaterally symmetrically about a corresponding one of said plurality of transverse minor axes.

13. A cleaning apparatus for cleaning from a moving web particles which are adhered to it by static electricity, of the type having a pair of oppositely facing suction hoods each having a pair of ionizing bars providing a source of high velocity ionized air, said ionizing bars comprising: a hollow tube having a longitudinal interior passageway extended substantially therethrough, said tube being electrically connectable to a source of electrical current and said interior passageway being connectable to a source of high velocity pressurized air; and a plurality of substantially parallel ionizing points extended from said tube in a radial direction along one axial side thereof, ones of said plurality of ionizing points comprising a hollow needle-like nozzle having an opening at a distal end thereof, said distal openings being in pneumatic communication through an interior of said hollow needle-like nozzle with said interior passageway;

wherein said distal end tapers substantially to a point around an entire circumference thereof.

* * * * *